United States Patent [19]

Bird et al.

[11] Patent Number: 4,812,948

[45] Date of Patent: Mar. 14, 1989

[54] SHOE GROUNDING STRAP

[75] Inventors: Gerald C. Bird; Orville M. Wiste, both of Round Rock, Tex.

[73] Assignee: Minnesota Mining and Manufacturing Company, St. Paul, Minn.

[21] Appl. No.: 168,375

[22] Filed: Mar. 15, 1988

[51] Int. Cl.[4] ..... H05F 3/02

[52] U.S. Cl. ..... 361/223

[58] Field of Search ..... 361/220, 223, 224

[56] References Cited

U.S. PATENT DOCUMENTS 2,785,344 3/1957 Hines ..... 361/223

2,955,234 10/1960 Price ..... 361/223

3,832,598 8/1974 Oehmke et al. ..... 361/223

4,249,226 2/1981 Westberg et al. ..... 361/223

*Primary Examiner*—L. T. Hix

*Assistant Examiner*—Brian W. Brown

*Attorney, Agent, or Firm*—Donald M. Sell; Walter N. Kirn; John C. Barnes

[57] ABSTRACT

A shoe ground strap which has a static dissipative exposed surface and offers protection against static charges building on the wearer and offers protection against electrical hazards if contacting a source of electrical power. The strap comprises a band comprising a conductive metal ribbon, a static dissipative material and an adhesive layer to aid in holding the strap to the shoe, with at least the surface and the two edges of the band covered by said static dissipative material to expose only the static dissipative material.

18 Claims, 1 Drawing Sheet

SHOE GROUNDING STRAP

BACKGROUND OF THE INVENTION

1. Field of the Invention

This invention relates to a grounding strap for shoes for the purpose of preventing the build-up of static electricity on personnel who work in areas where there exists a potential hazard in the event the individual contacts a static sensitive object or comes into contact with a source of electrical energy of damaging proportions, and in one aspect to a laminate comprising narrow strip of static dissipative material substantially covering a strip of malleable conductive metallic material, and an adhesive coating for connecting the same to the shoe of an individual.

2. Description of the Prior Art

The value or benefits to be gained by providing personnel working in assembly areas of sensitive electronic parts or working to repair equipment in an area where there is the danger of shock is known and there have been many inventors and companies providing products to offer the protection necessary. These prior products however have left the personnel exposed to harm in the event the individual were to touch a source of electrical power which is hazardous in any event. However, with a dissipative shoe strap rather than a conductive shoe strap such as the prior grounding straps, an example of which is U.S. Pat. No. 4,249,226, the strap restricts possible harm should the wearer's foot come in contact with a source of electrical power unless there is an unprotected edge of the conductive layer exposed. It is important that the grounding strap provide the wearer at all times with the semiconductive static dissipative surface between an object at a different potential than the body, and the body.

Therefore, it is an object of the present invention to provide an improved shoe strap which will not have an exposed conductive surface but will have a static dissipative layer between the conductive layer and the exterior or the exposed surface at the strap.

SUMMARY OF THE INVENTION

The present invention provides an improved shoe strap construction. The shoe strap of the present invention comprises a narrow conformable band comprising a strip of electrically conductive material coated with a static dissipative material such that at least one side and the two narrow edges of the band are formed by the static dissipative material, and which preferably has a layer of pressure sensitive adhesive material on one surface for removably adhering the band to the bottom of the wearers shoe.

The strap material is adapted to be wound in a roll allowing the person desiring to be grounded with a conductive floor to cut from the roll a length of material long enough to wrap under the shoe heel and into the sides of the shoe. In this way the operator is in contact with the dissipative layer and is electrically connected to the conductive floor but protected from electrical hazards. The strap material may also be provided in strips of the width and length desired to wrap around the heel of a shoe. The strips can be provided in a pad.

The strap material of the present invention comprises a narrow ribbon of conductive material, e.g., $10^{-6}$ ohm cm such as aluminum foil, which is covered on at least three sides by a static dissipative material with a volume resistively, of at least $10^{6}$ ohm cm, such as vinyl material having a thickness of about 0.01 inch (0.25 mm) and a coating of a pressure sensitive adhesive coated on the exposed side of the foil. The foil may be totally covered by the vinyl coating and the adhesive would then be coated on over one width of the resulting band of material. The adhesive is coated to a thickness of about 0.003 inch (0.008 cm) and is sufficient to cover the conductive foil. The foil has a thickness of about 0.002 inch (0.005 cm). The resulting strap material is thus flexible and easily bent to conform to the shape of the shoe and be adhered to the shoe.

BRIEF DESCRIPTION OF THE DRAWING

The invention will be described in greater detail with reference to the drawing wherein.

DESCRIPTION OF THE PREFERRED EMBODIMENT

Figure 1:
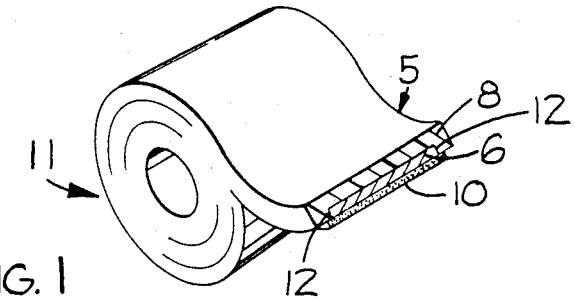
FIG. 1 is a schematic view of a roll of strap material according to the present invention illustrating the cross section of the material.

Referring now to the drawing, the strap material of the present invention comprises a band 5 comprising a ribbon of conductive material 6, on three sides of which is applied a static dissipative polymeric composition 8, and which has a layer of adhesive material 10 covering the fourth side.

The conductive material 6 is a thin supple metallic material and the coating of polymeric material is thin, resulting in a flexible readily conformable band. The adhesive material is coated on the exposed surface of the conductor 6 to removably adhere the strap material to the shoe of the operator desiring to be grounded to a conductive floor.

The strap material of the present invention is adapted to be wound in a roll 11 with the adhesive coated surface contacting the outer convolution of the roll. Depending on the composition of the polymeric material 8 and the adhesive material 10, the exposed surface thereof opposite the adhesive coated surface may be coated with a suitable release coating to afford facile unwinding of the strap material from the roll.

As illustrated in FIG. 1 the polymeric material 8 is coated onto the conductive ribbon, which is preferably a narrow ribbon of malleable metal such as aluminum foil having a thickness of between about 0.002 inch (0.05 mm) and about 0.005 inch (0.127 mm), and the coating is applied in a width greater than the width of one side of the foil; normally 0.5 inch (1.27 cm), to also coat the narrow edges 12 of the foil. The foil is very conductive, having a resistivity of about $10^{-6}$ ohm cm and it is desirable not to have the edges or any portion of the sides exposed, thus avoiding a potential electrical hazard to the operator who comes into contact with an electrical power source while standing on a conductive surface.

Figure 2:
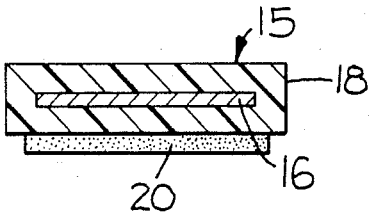
FIG. 2 is a cross sectional view of a further embodiment of the strap material of the present invention.

FIG. 2 illustrates the structural make up of another embodiment of the strap material which is generally designated 15. This strap material is also a thin flexible band like the strap material 5 and comprises a ribbon of conductive material 16 which is coated with a polymeric composition 18 in such a manner that the ribbon 16 is coated on both sides and both edges. The polymeric material on one side surface is then coated with an adhesive material 20. In this embodiment the strap material 15 is thin and flexible with the coating of polymeric material 18 being about 0.010 inch (0.254 mm) thick over the surface of the conductive material 16. The strap of FIG. 1 or FIGURE may be 0.5 to 1 inch (1.27 to 2.54 cm) wide.

The strap material 5 or 15 can be pulled from the roll and cut to length sufficient to fit about the heel of a shoe 22. The strap material 5 or 15 is affixed at one end in the inside of the shoe 22 and placed along the side to the heel 23, onto the bottom of the heel, and up the other side of the shoe and the terminal end is then stuck to the inside of the heel portion of the shoe. The ends of the strap material assure contact with the wearer of the shoe to provide a ground path to a conductive deck or floor.

Figure 4:
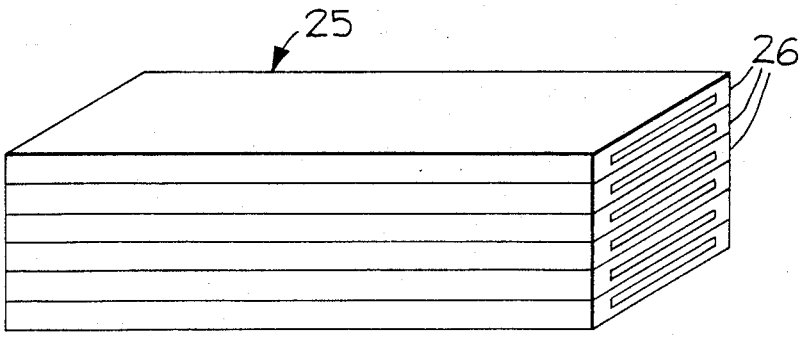
FIG. 4 is a perspective view of a pad of shoe straps.

Referring to FIG. 4, there is illustrated a pad 25 of protective shoe straps 26. The shoe straps 26 can be formed from cut lengths of material as illustrated in FIG. 1 or they can be formed similar to the straps illustrated in cross section in FIG. 2 and comprise a ribbon of conductive material embedded in the narrow band of static dissipative material. One side surface of the static dissipative material is coated with a pressure sensitive adhesive layer and the opposite side surface is coated with a low adhesion coating to permit the straps to be stacked and a strap 26 to be later removed by peeling the same from the pad.

Figure 3:
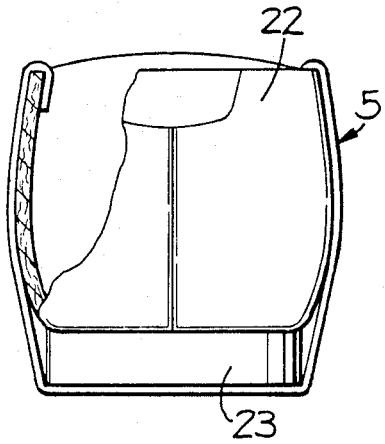
FIG. 3 is a back view of a shoe, partially in section, illustrating a length of the strap material anchored to the shoe.
Figure 5:
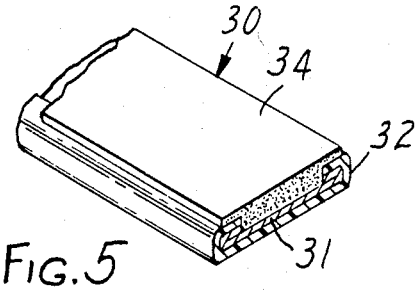
FIG. 5 is a fragmentary perspective view of another embodiment of the strap of the present invention.

The strap material of FIG. 5 comprises a band 30 comprising a ribbon 31 of conductive material such as aluminum foil covered on one side with a static dissipative polymeric material 32. The edges of the band are formed by folding or rolling the longitudinal edges of the laminate to form the edges of the band of the polymeric material. A layer of pressure sensitive adhesive 34 is applied to the other side of the conductive material 31 for applying the band to a shoe as illustrated in FIG. 3. The straps 30 may be 0.5 to 1 inch (1.27 to 2.54 cm) wide with the conductive foil having a thickness of 0.002 to 0.005 inch (0.05 to 0.127 mm) and the polymeric material is 0.005 to 0.015 inch (0.127 to 0.38 mm) thick.

A specific example of the static dissipative shoe strap material for the embodiment of FIG. 1 is as follows:

| Static Dissipative Outer Layer | |
|---|---|
| Material | Parts by Weight |
| (a) Resin: Copolymer, 95% polyvinyl chloride, 5% vinyl acetate | 100.0 |
| (b) Diisononyl phthalate | 67.8 |
| (c) Calcium carbonate | 55.5 |
| (d) Butyl benzyl phthalate | 10.0 |
| (e) Epoxidized soybean oil | 8.9 |
| (f) Antimony oxide | 7.0 |
| (g) Pigment | 6.0 |
| (h) Barium/zinc liquid | 2.0 |
| (i) Alkyl aryl phosphite | 1.0 |
| (j) Ethoxylated isostearyl alcohol | 1.0 |
| (k) Fungicide | 0.56 |

Above mixed with a paddle type mixer under methods common to plastisol industry. Volume resistivity expected to be in the order of $5\times10^9$ ohm-cm.

Conductive Material:

1145-0 0.002 inch (0.051 mm) thick Aluminum Foil

Pressure Sensitive Adhesive:

Medium tack acrylic pressure-sensitive adhesive system such as 3M Scotch Brand Joining Systems #665 linerless double coated film tape available from Minnesota Mining and Manufacturing Company, St. Paul, Minn.

Method of Manufacture:

The static dissipative mixture described above is knife coated on to the conductive aluminum layer and passed through a fusing oven set at 365 degrees F (185 degrees C). Coatings were made in the range of 0.005 to 0.030 inches (0.127 to 0.762 mm) thick and found to be fused and static dissipative in the range described.

The fused material then has the adhesive backing layer applied, and the material slit into the width desired for finished product, for example 0.5 inch (12.7 mm).

The slit material is then passed through a 3 roll calender with sufficient heat, such as 265 degrees F (130 degrees C), to cause the dissipative vinyl to form around the edges of the conductive layer. One roll of the 3 roll calender is chilled sufficiently to maintain the newly formed material in its new configuration.

The described example yielded a product to have a resistance to ground of 7 megohms, to be removably applicable to a shoe heel, and to remove a 5000 volt charge in less then 10 msec.

Having described the invention with reference to several embodiments, it will be appreciated that other modifications may be made without departing from the invention as defined in the appended claims.

We claim:

1. A shoe strap for use in dissipating static electricity from the body of a person to a conductive surface and for protecting the person from electrical hazards, said strap comprising:

an elongate band having two sides and two narrow edges, said band comprising a ribbon of conductive material and static dissipative polymeric material coated on said ribbon and disposed on at least one side and said narrow edges of said band; and pressure sensitive adhesive means coated on said other side of said band for adhering said strap to a shoe and for exposing only said static dissipative material when said strap is adhered to a said shoe.

2. A shoe strap according to claim 1 wherein said ribbon is a thin narrow band of malleable metal.

3. A shoe strap according to claim 2 wherein said metal is a thin band of aluminum.

4. A shoe strap according to claim 1 wherein said band has said static dissipative polymeric material applied on said other side between a surface of said ribbon and said adhesive means.

5. A shoe strap according to claim 2 wherein said narrow edges comprise folded edges of said ribbon and said polymeric with said ribbon folded upon itself.

6. A shoe strap according to claim 1 wherein said band is co wound in a roll.

7. A shoe strap according to claim 1 wherein a plurality of shoe straps are disposed one upon the other in aligned relationship to form a pad.

8. A static dissipative shoe strap for draining static electricity from a person to ground from the bottom of a shoe and protecting the person from electrical hazards, said shoe strap comprising:

a narrow thin ribbon of conductive malleable metal having two sides and two narrow edges;

a static dissipative polymeric material on said ribbon to cover one side and the narrow edges of said ribbon, said polymeric material being sufficiently thin to permit the ribbon to be bent upon itself and retain said bent position; and pressure sensitive adhesive means applied to one side of said strap for aiding in maintaining the ends of said strap in the inside of the shoe, with the strap positioned down the sides, beneath the heel and along the opposite side and into the shoe and for exposing only said polymeric material.

9. A shoe strap according to claim 8 wherein said static dissipative polymeric material has a volume resistivity of $10^5$ to $10^{12}$ ohm cms.

10. A shoe strap according to claim 8 wherein said metal is aluminum.

11. A shoe strap according to claim 8 wherein said polymeric material is on both sides of said ribbon.

12. A shoe strap according to claim 8 wherein said adhesive means is applied along the length of said strap.

13. A shoe strap according to claim 10 wherein said ribbon of aluminum is about 1.27 cm wide and between about 0.005 cm and 0.0127 cm thick.

14. A shoe strap according to claim 8 wherein said strap is convolutely wound in a roll.

15. A shoe strap according to claim 6 wherein a plurality of shoe straps are disposed one upon the other in aligned relationship to form a pad.

16. A static dissipative shoe strap for draining static electricity from a person to ground from the bottom of a shoe and protecting the person from electrical hazards, said shoe strap comprising:

a band of a laminate comprising a narrow thin ribbon of conductive malleable metal and a coating of static dissipative polymeric material on one surface of said ribbon, the edges of said band being folded to fold said metal onto itself for forming edges of said band of said polymeric material, said coating being sufficiently thin to permit the ribbon to be folded and retain said folded position; and a layer of pressure sensitive adhesive applied to said ribbon for maintaining said band in the inside of the shoe, down the sides, beneath the heel and along the opposite side and into the shoe.

17. A shoe strap according to claim 16 wherein said static dissipative polymeric material has a volume resistivity of $10^5$ to $10^{12}$ ohm cms.

18. A shoe strap according to claim 17 wherein said metal is aluminum.

* * * * *